US008146626B2

(12) United States Patent
Purnhagen et al.

(10) Patent No.: US 8,146,626 B2
(45) Date of Patent: Apr. 3, 2012

(54) FLEXIBLE CONTAINER, METHOD AND DEVICE FOR FILLING SAID FLEXIBLE CONTAINER

(75) Inventors: Heinz Purnhagen, Rheine (DE); Siegfried Hartmann, Ibbenbüren (DE)

(73) Assignees: Nordenia Deutschland Emsdetten GmbH, Emsdetten (DE); Reis GmbH & Co. KG Maschinenfabrik, Obernburg (DE)

( * ) Notice: Subject to any disclaimer, the term of this patent is extended or adjusted under 35 U.S.C. 154(b) by 1236 days.

(21) Appl. No.: 11/908,618

(22) PCT Filed: Mar. 15, 2006

(86) PCT No.: PCT/EP2006/002399

§ 371 (c)(1),
(2), (4) Date: Sep. 14, 2007

(87) PCT Pub. No.: WO2006/097300

PCT Pub. Date: Sep. 21, 2006

(65) Prior Publication Data

US 2009/0229703 A1 Sep. 17, 2009

(30) Foreign Application Priority Data

Mar. 15, 2005 (DE) ..... 10 2005 011 813

(51) Int. Cl.
*B65B 43/42* (2006.01)

(52) U.S. Cl. ..... 141/166; 141/83; 141/313; 141/314; 53/469

(58) Field of Classification Search ..... 141/10, 141/166, 287, 313, 314, 83; 53/459, 469
See application file for complete search history.

(56) References Cited

U.S. PATENT DOCUMENTS

| | | | | | |
|---|---|---|---|---|---|
| 4,182,386 | A | * | 1/1980 | Alack | 141/83 |
| 4,364,424 | A | | 12/1982 | Nattrass et al. | |
| 4,574,720 | A | * | 3/1986 | Lepisto | 141/10 |
| 4,703,782 | A | * | 11/1987 | Henkel, Sr. | 141/65 |
| 5,348,063 | A | * | 9/1994 | Handleman | 141/314 |
| 5,443,102 | A | * | 8/1995 | Svendsen | 141/10 |
| 5,518,048 | A | * | 5/1996 | Derby | 141/80 |
| 5,682,929 | A | * | 11/1997 | Maginot et al. | 141/65 |
| 5,809,744 | A | * | 9/1998 | Villines et al. | 53/434 |
| 5,810,060 | A | * | 9/1998 | Bolz et al. | 141/97 |
| 5,975,155 | A | * | 11/1999 | Sienerth et al. | 141/84 |
| 6,112,504 | A | * | 9/2000 | McGregor et al. | 53/417 |
| 6,550,226 | B1 | * | 4/2003 | Gates et al. | 53/459 |
| 7,004,212 | B2 | * | 2/2006 | Gill et al. | 141/316 |
| 2003/0217528 | A1 | | 11/2003 | Wilson | |

FOREIGN PATENT DOCUMENTS

DE 36 06 593 A1 9/1987

* cited by examiner

*Primary Examiner* — Timothy L Maust
(74) *Attorney, Agent, or Firm* — Gudrun E. Huckett

(57) ABSTRACT

A flexible container has a container body with container walls that define a container interior. A container socket is connected to the container body and has a container opening through which the container interior is filled. Carrying loops are connected to the container body for lifting the container. The container socket has an initial retracted position in the container interior and is transferable from the initial retracted position into an upright filling position. The container socket is at least partially comprised of an elastically expandable material. The flexible container is filled by inserting into the container socket a filling tube, contacting with the filling tube the container socket in the initial retracted position, and transferring the container socket to the upright filling position and keeping the container socket secured on the filling tube in the upright filling position. The bulk material is introduced through the filling tube into the flexible container.

12 Claims, 4 Drawing Sheets

FLEXIBLE CONTAINER, METHOD AND DEVICE FOR FILLING SAID FLEXIBLE CONTAINER

BACKGROUND OF THE INVENTION

The invention relates to a flexible container, in particular a flexible bulk container, comprising a container body as well as a container interior delimited by container walls. The container interior can be filled with bulk material by means of a container socket comprising a container opening. The container comprises carrying loops preferably attachable to the container body by means of which the container can be lifted.

Moreover, the invention relates to a device for filling a flexible container of the aforementioned kind. Furthermore, the invention relates to a method for filling a flexible container of the aforementioned kind.

Flexible containers of the aforementioned kind are generally known and serve in particular for transporting and storing bulk material, for example, chemicals in powder form or foodstuffs such as spices and liquids. The containers are stored folded in the unfilled state and, generally, must be unfolded manually for a subsequent filling process. The container opening is usually arranged in a container socket that is to be manually connected to a filling tube for the filling process. In this connection, the operating personnel must take care that a secure connection between the container opening socket and the filling tube of the filling device is provided. This is a detriment in regard to automation of such a filling process.

SUMMARY OF THE INVENTION

It is an object of the present invention to provide a flexible container of the aforementioned kind that is configured such that it can be handled for a filling process with simple process-technological means.

Moreover, it is an object of the present invention to provide a device and a method with which a flexible container can be filled with a high degree of automation.

As a solution to this object the flexible container of the aforementioned kind is characterized firstly in that the container socket is transferable from an initial position essentially in or near the container interior into an upright filling position and at least portions of the container are comprised of a material that can be elastically expanded.

In this way, a flexible container is made available that is greatly suitable to be filled in an automated fashion in that into the container socket a filling tube of a corresponding device can be inserted that can move the container socket in an automated fashion into a lifted or erected filling position. The container is advantageously provided for this purpose with an inwardly turned conical container socket. As a result of the conical configuration and the otherwise circular cross-section of the container socket, a filling tube can be positioned safely within the container socket of the flexible container. With appropriate spreader arms or preferably by means of a blowing sleeve provided on the filling tube, the container socket can be elastically expanded and can be pulled out by means of the filling tube and turned outwardly. As a result of the conical shape of the container socket the filling tube that has been expanded by means of the blowing sleeve can be guided easily through the container opening of the container socket. In the outwardly turned position, the flexible container can be filled, also when suspended from its carrying loops, for example. During this suspended stocking, it is also possible to weight the container.

Preferably, the carrying loops are provided on two opposite sidewalls of the container body into which, for example, arms of a robot device can be inserted. In this way, the carrying loops provided on opposite sides can be centrally gripped by robot gripping devices and can be held in position during filling by means of a spreading mechanism, for example. As a result of expanding the filling tube, for example, by means of a blowing sleeve, filling can be carried out in a sealed fashion. In this way, dust loading during the filling process can be safely prevented, for example.

Moreover, in particular the area that surrounds the container socket is provided with a surface that is appropriate for a vacuum device. This can be, for example, a fabric that is coated on both sides with an increased quantity of applied coating material. For example, an applied coating quantity of 40 to 50 g/m$^2$ as compared to a conventionally applied coating quantity of 25 g/m$^2$ can be provided. Moreover, a special calendered fabric treatment (CURF) can be provided. It has been found to be expedient to provide in this connection an average surface roughness that is between 0.025 μm and 12.5 μm so that, for example, by suitable vacuum nozzles that are provided, for example, on a single arm robot, a folded FIBC (flexible intermediate bulk container) can be removed from a storage pallet and put in an upright position by means of vacuum.

It is also possible that the flexible container is filled while standing. For this purpose, a filling tube can be inserted by means of a device into the container socket and the filling tube, for example, by means of a blowing sleeve, transfers the container socket into an outwardly pulled or turned filling position. By means of the conical shape of the container socket, the expanded filling tube that has been expanded by means of the blowing sleeve can be passed through the container opening of the container cover. In the outwardly turned position the container can be supplied with air so that it can be filled while standing upright on its own. Weighing can be done by means of a platform scale.

The invention concerns a device that can be used for automated filling of the afore described container. It is decisive also in this connection that a translatorily moved filling tube is provided that can be immersed into the corresponding container socket. The control of this filling tube can be realized by means of electric motor drives or also by hydraulic or pneumatic drives wherein corresponding control devices can control these processes and display them. This devices can have spreading arms but also vacuum nozzles in order to suck the container socket so tightly against the filling tube that it can be lifted and filled. It is particularly preferred that on this filling tube a blowing sleeve is arranged that, after corresponding activation can be filled with compressed air whereupon the container socket of the flexible container is expanded in areas thereof. The blowing sleeve represents a type of spreading or tensioning ring against which the container socket material rests very tightly and thus in a dust-tight way. As a result of the conical configuration, the filling tube can be moved by a translatory movement out of the container. Moreover, the device can also have arms, for example, on a single arm robot, in order to engage the carrying loops on the container so that the container can be filled while suspended. In this connection, load cells for weighing the container can be provided also.

A corresponding method for automated filling of a container is explained in more detail in the following.

BRIEF DESCRIPTION OF THE DRAWINGS

Further details of the invention and its advantages result from the additional description, additional claims, and the subsequently described drawings. The drawings show in:

DESCRIPTION OF PREFERRED EMBODIMENTS

Figure 1:
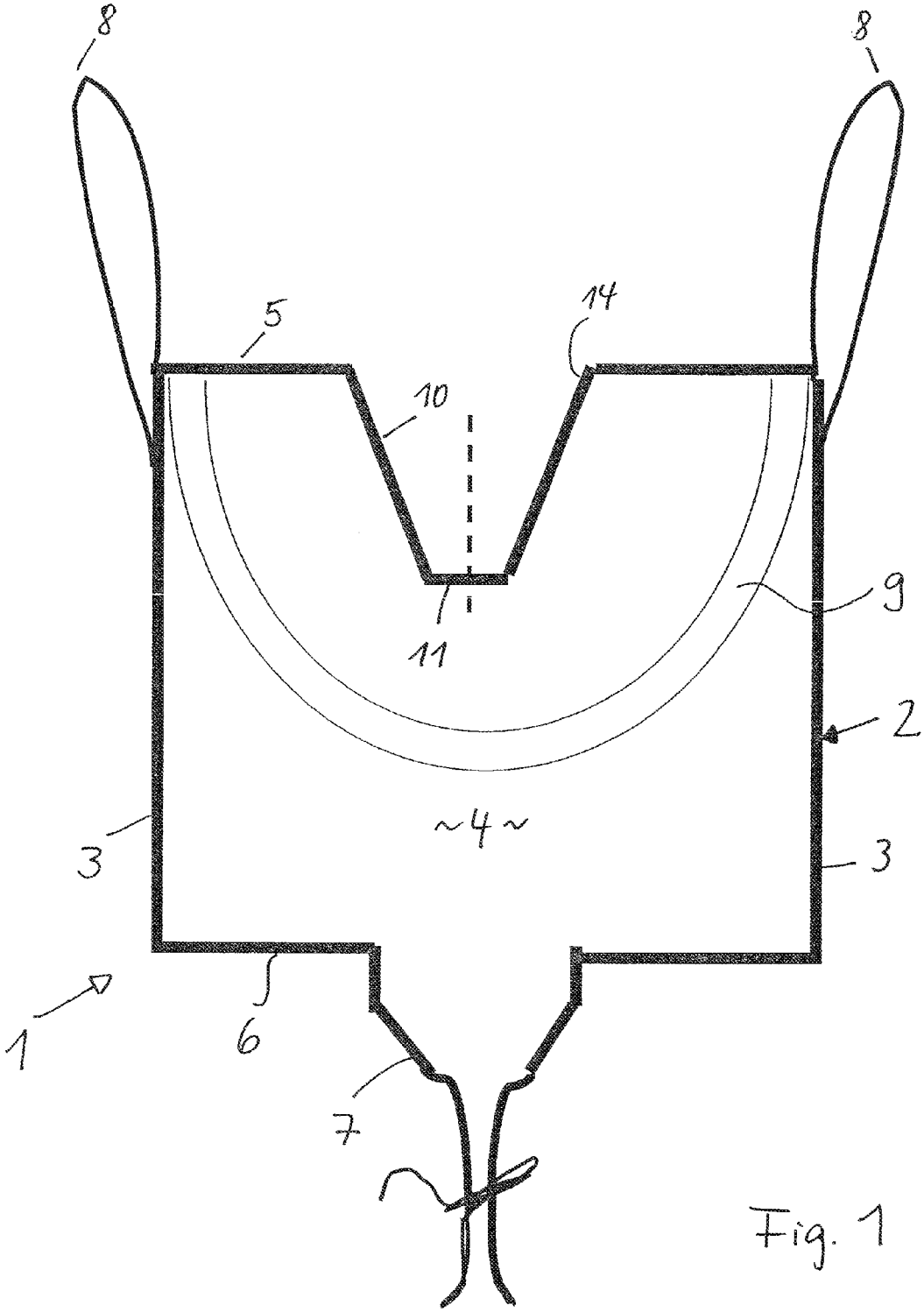
FIG. 1 in a schematic cross-section illustration an embodiment of a flexible container in a state before filling.

In the drawing, parts that act in principle in the same way are identified with same reference numerals. In general, 1 indicates in the illustrated embodiment a flexible bulk material container FIBC (flexible intermediate bulk container). It has a container body 2 with sidewalls 3, a container interior 4, a cover 5 as well as a bottom area 6 where an outlet socket 7 is provided. In all four corner areas there are carrying loops 8. Moreover, on two sidewalls a large carrying loop 9 is provided, respectively, that can be engaged by the gripping arms of a robot for filling the container 1 while it is suspended. In the central area of the cover 5 a container socket 10 is arranged.

In the initial position of the container illustrated in FIG. 1, after having been unfolded, from a storage pallet, for example, the container socket 10 faces the container interior 4. This container socket 10 is shaped like a truncated cone and has thus a conically tapering downwardly extending area having otherwise a basic circular cross-section, respectively. The opening of the container socket 10 is indicated at 11.

The material of the container socket 10 is selected such that the container socket 10, at least over portions thereof, can be elastically expanded or, alternatively, this material is so flexible that it can be sucked by vacuum nozzles against a filling pipe 17 in such a way that it will adhere tightly on the filling tube 17. The same holds true also in the case of spreading or expanding the container socket 10. In this connection, the elastically expandable material must ensure that it rests exactly against, for example, a blowing sleeve 18, a ring, a spreading arm or the like, in such a way that it surrounds approximately tightly the filling tube at least in this area and rests against the filling tube 17 with such a spreading or securing force 17 that the filling tube 17 can move the container socket 10 from its initial position into the filling position illustrated in FIG. 2.

Figure 2:
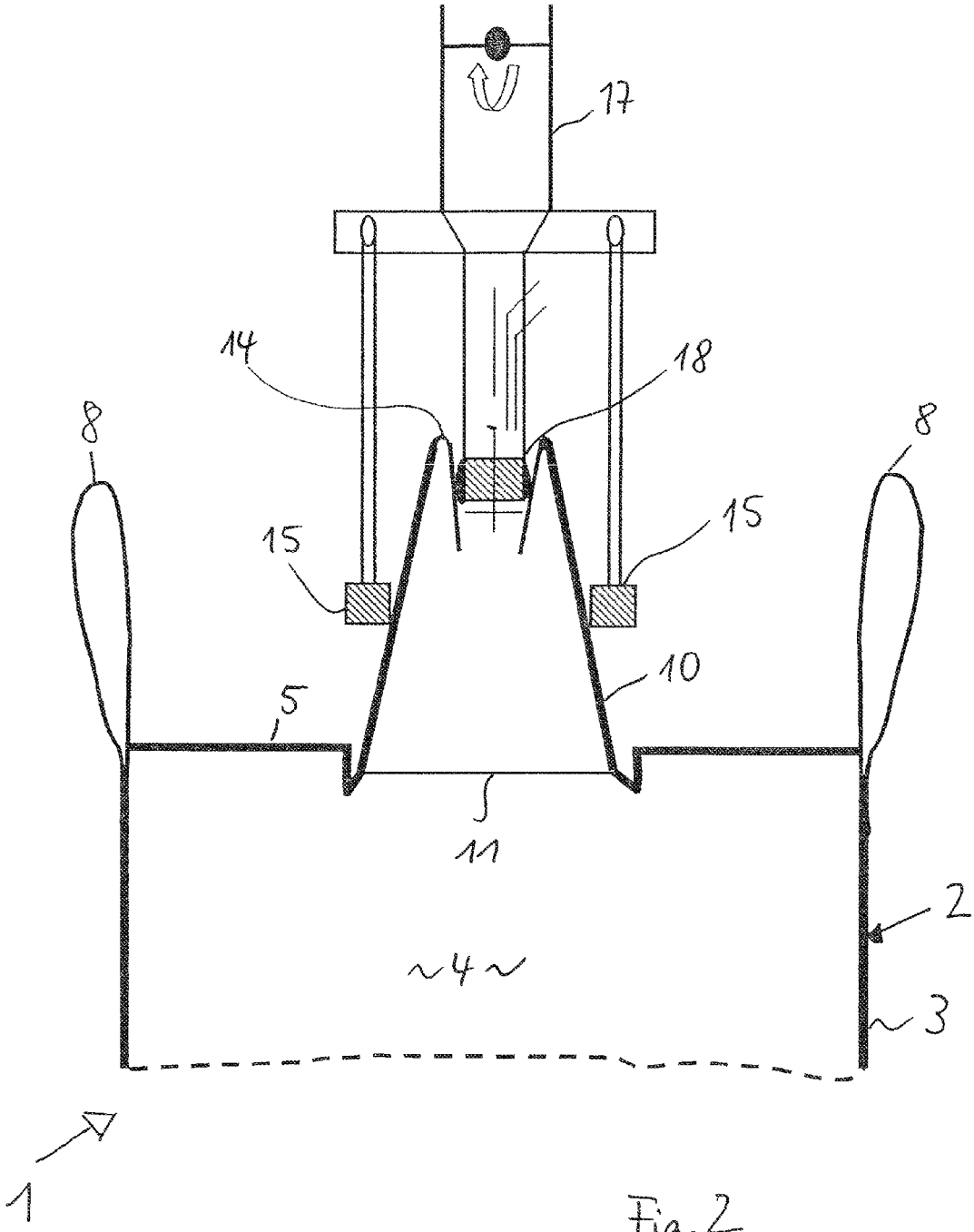
FIG. 2 the embodiment according to FIG. 1 with pulled-out container socket during a filling process.

In FIG. 2, the flexible container 1 is shown wherein the container socket 10 has been transferred by the filling tube 17 into its filling position. In this connection, the filling tube 17 has been immersed with the blowing sleeve 18 first into the filling socket 10, namely into its initial position according to FIG. 1. The blowing sleeve 18 has been supplied with compressed air. Subsequently, a wall area of the container socket 10 has been elastically expanded and rests very tightly against the blowing sleeve 18. This is the area that still surrounds the blowing sleeve 18 in FIG. 2. The filling tube 17 has thus been introduced relatively far into the container socket 10 in its initial position according to FIG. 1 so that the filling tube 17 together with the blowing sleeve 18 can be moved safely out of the opening 14 in the container cover 5. During this movement from the initial position into the filling position, the container socket 10 has been turned up. This is illustrated by means of the ends.

Figure 3:
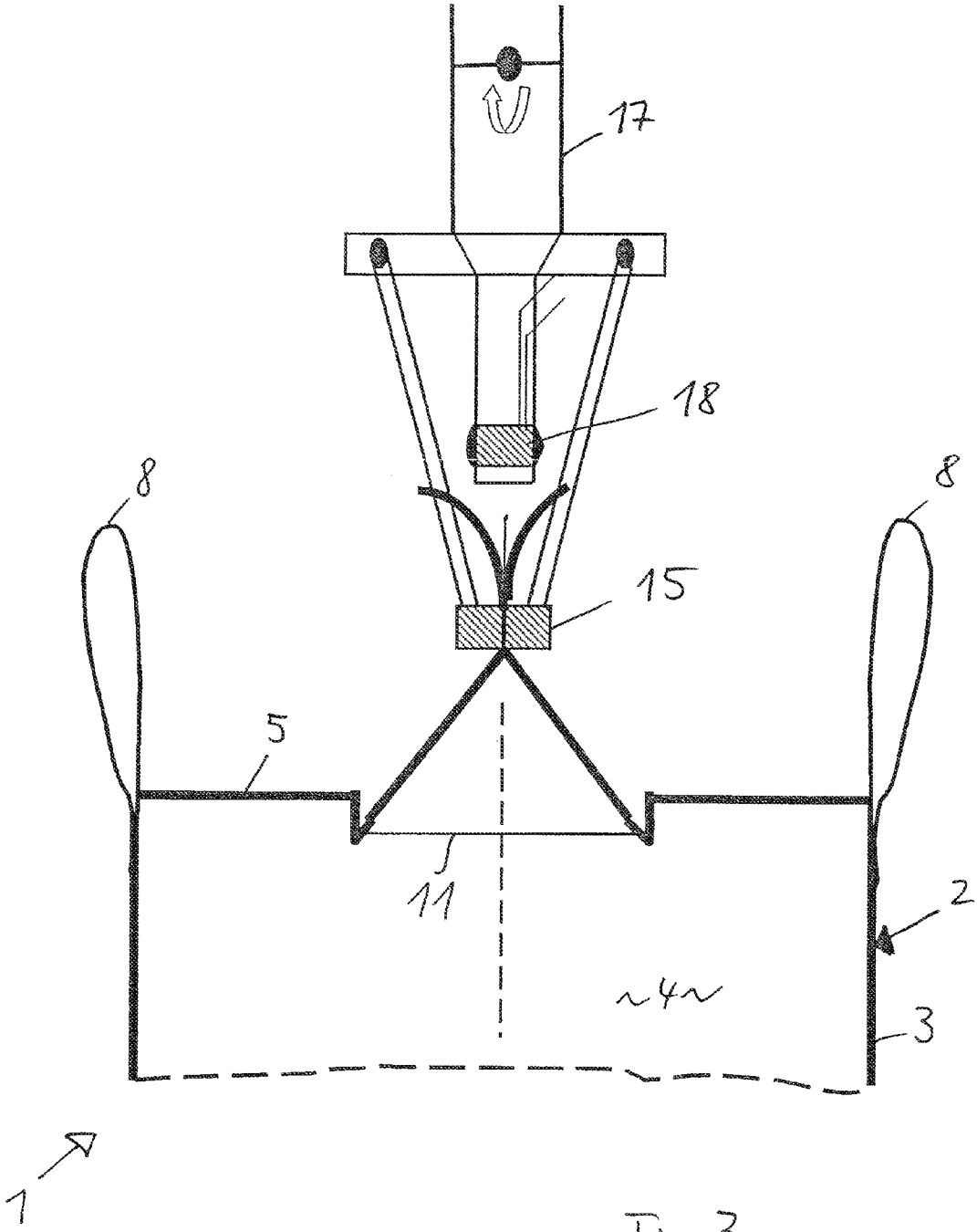
FIG. 3 an illustration in analogy to FIG. 2 during the closing process of the container socket.

The carrying loops 9 on two sidewalls of the container 1 are not shown in detail in FIG. 2; the carrying loops can support the container 1 in this filling position in that e.g. two arms of a robot engage them and lift the container 1. During this phase, an automated weighing of the container 1 or of the filled-in contents can be realized. Moreover, FIG. 2 shows that the fusing jaws 15 are provided in order to close off the container socket as illustrated in more detail in FIG. 3. In FIG. 2, the fusing jaws 15 are still in their initial position while in FIG. 3 they have been moved toward one another with subsequent heating in order to fuse the container socket 10.

Figure 4:
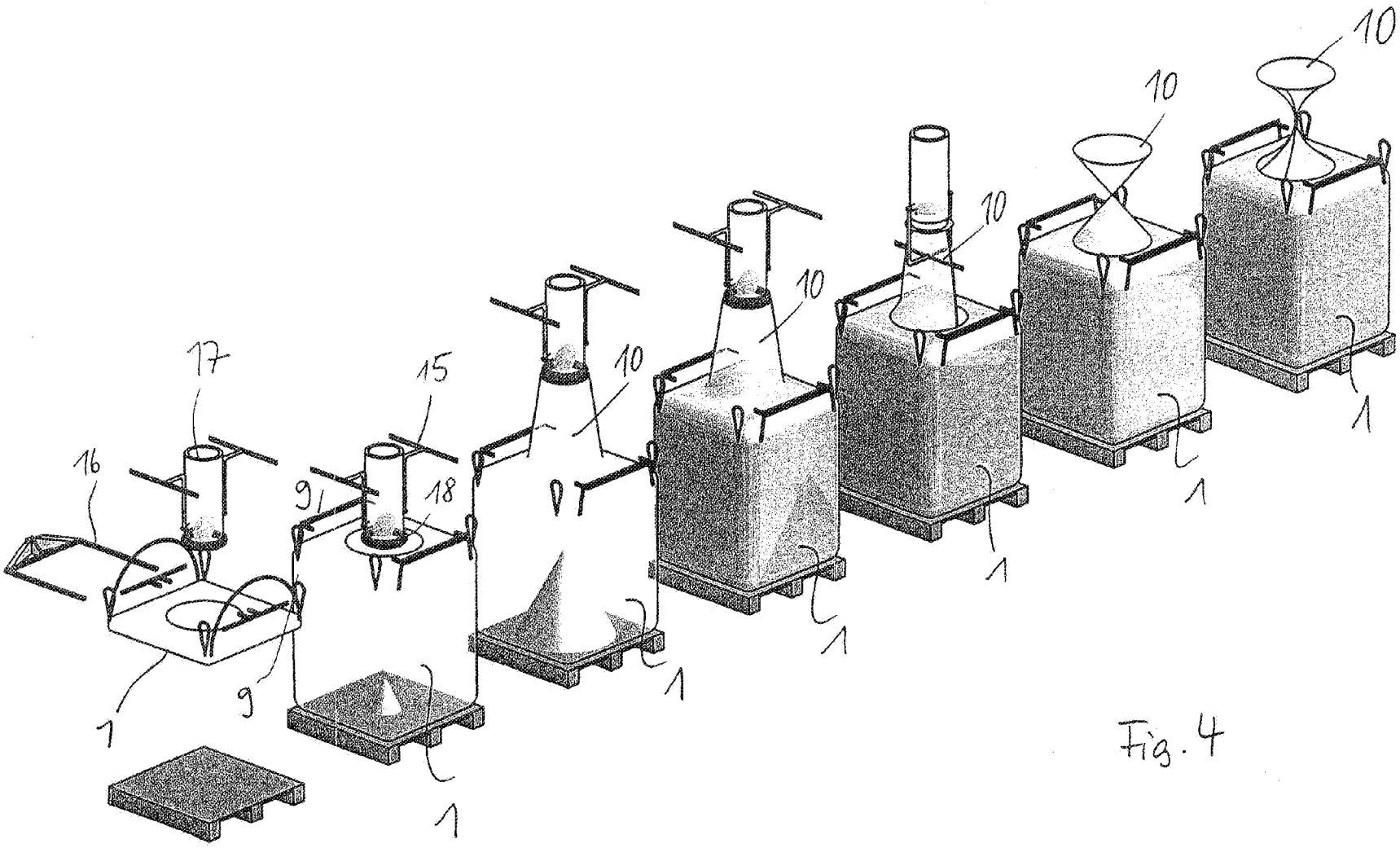
FIG. 4 a schematic process illustration of a filling process of a container according to the invention by means of a corresponding device according to the invention.

The illustration according to FIG. 4 shows the corresponding filling process. First, the robot arms 16 are inserted and the flexible container 1 is erected. Subsequently, the container 1 is held by means of the arms 16. At 17, the corresponding filling tube is illustrated. In the third position, the filling tube 17 with the blowing sleeve 18 in the container socket 10 has been pulled out of the interior of the container. In the third-to-last position the fusing device is lowered and the filling tube 17 is pulled out of the container socket 10 after filling has been accomplished. Subsequently, the fusing device is activated and container socket 10 can be closed.

What is claimed is:

1. A device for filling a flexible container, the flexible container comprising a container body comprising container walls that define a container interior; a container socket connected to the container body and having a container opening through which the container interior is fillable; carrying loops connected to the container body for lifting the container; wherein the container socket has an initial retracted position in the container interior and is transferable from the initial retracted position into an upright filling position; wherein the container socket is at least partially comprised of an elastically expandable material, the device comprising:

a filling device insertable into a container socket of the flexible container which container socket is positioned in a retracted position in a container interior of the flexible container;

wherein the filling device contacts the container socket when inserted and transfers the container socket from the retracted position inside the container interior into an upright filling position.

2. The device according to claim 1, wherein the filling device comprises a filling tube with which the container socket is expandable.

3. The device according to claim 2, wherein the filling tube has a blowing sleeve for expanding the container socket.

4. The device according to claim 1, wherein the filling device comprises a filling tube against which the container socket is attracted by suction and transferred in the upright filling position.

5. The device according to claim 1, wherein the filling device has a vacuum device by means of which container wall areas adjacent to the container socket are supplied with vacuum.

6. The device according to claim 5, wherein the vacuum device is provided on a single arm robot.

7. The device according to claim 5, wherein the vacuum device lifts the flexible container and transfers the flexible container into a filling position.

8. A method for filling a flexible container, the flexible container comprising a container body comprising container walls that define a container interior; a container socket connected to the container body and having a container opening through which the container interior is fillable; carrying loops connected to the container body for lifting the container; wherein the container socket has an initial retracted position in the container interior and is transferable from the initial retracted position into an upright filling position; wherein the container socket is at least partially comprised of an elastically expandable material, the method comprising the steps of:

inserting into a container socket of a flexible container a filling tube, wherein the container socket is in an initial retracted position inside the flexible container;

contacting with the filling tube the container socket in the initial retracted position;

transferring the container socket to an upright filling position and keeping the container socket secured on the filling tube in the upright filling position;

introducing bulk material through the filling tube into the flexible container.

9. The method according to claim 8, wherein the container socket is expandable by compressed air supplied through the filling tube.

10. The method according to claim 8, further comprising the steps of lifting and weighing the flexible container by carrying loops attached to the flexible container.

11. The method according to claim 8, further comprising the steps of blowing air into the flexible container and weighing the container in an upright position.

12. The method according to claim 8, further comprising the step of closing the container socket after filling by a clip or by fusing.

* * * * *